US005496982A

United States Patent [19]

Tsai

[11] Patent Number: 5,496,982

[45] Date of Patent: Mar. 5, 1996

[54] KEY SWITCH

[75] Inventor: Ching-Cheng Tsai, Keelung, Taiwan

[73] Assignee: Chicony Electronics Co., Ltd., Taipei, Taiwan

[21] Appl. No.: 254,607

[22] Filed: Jun. 6, 1994

[51] Int. Cl.[6] ..... H01H 13/70

[52] U.S. Cl. ..... 200/345

[58] Field of Search ..... 200/54, 512–517, 200/341–345, 306

[56] References Cited

U.S. PATENT DOCUMENTS

| | | | |
|---|---|---|---|
| 4,099,037 | 7/1978 | Hartzler et al. | 200/5 A |
| 4,596,912 | 6/1986 | Hattori | 200/302.2 |
| 5,154,282 | 10/1992 | Pascal | 200/345 |
| 5,199,556 | 4/1993 | Lee | 200/345 |
| 5,283,408 | 2/1994 | Chen | 200/345 |
| 5,310,973 | 5/1994 | Lee | 200/345 |
| 5,345,051 | 9/1994 | Miike | 200/341 X |
| 5,380,969 | 1/1995 | Yang | 200/5 A X |

*Primary Examiner*—J. R. Scott

*Attorney, Agent, or Firm*—Browdy and Neimark

[57] ABSTRACT

A key switch for a keyboard frame with a circuit board underneath includes a square-section key base, a key body sliding up and down in the key base, a key cap pressed into the key body, and a rubber cone between the key body and the circuit board. The cap includes a plunger with a downward-opening inner hole, whose lower rim contacts the upper side of the cone. The key base has four walls forming a square tube extending up from the keyboard frame surface. At the upper end of the walls are flanges extending in from the walls; each flange has a central flange notch, and between each pair of flanges is a 45-degree bevel extending across each of the base corners. The key body includes four stub rods that slide within the corners of the key base; each of the stub rods has an upper stop surface that limits the upward travel of the key body by abutting against the underside of a respective bevel. A central square through-hole in the key body is sized to accept the plunger of the key cap, and has four air passages along the corners of the through-hole to act as air bleeds. The air passages communicate with the inner hole of the key cap. A single projection on the key body can be aligned with one of the flange notches to orient the key cap.

1 Claim, 4 Drawing Sheets

KEY SWITCH

BACKGROUND OF THE INVENTION

The present invention relates to a key switch for a keyboard which produces little friction force and effectively eliminates the formation of a vacuum during the operation of the key switch.

Various key switches have been disclosed for computer keyboards. FIGS. 4 and 5 show a structure of key switch according to the prior art. This structure of key switch comprises an open key base 1' made on the frame of a keyboard, a key body 2' movably received within the key base 1', a key cap 3' spaced above the key base 1' and coupled to the key body 2', and a rubber cone 4' mounted on the circuit of the keyboard and disposed below the key body 2'. The key cap 3' has triangular bottom rods 3A respectively extended from the bottom thereof in four corners. The key base 1' has four longitudinal grooves 1A of arched cross section in the four corners thereof on the inside. The key body 2' comprises four triangular mounting slots 2A at the top, which receive the four triangular bottom rods 3A of the key cap 3' respectively, a flat bottom wall 2C supported on the rubber cone 4' at the top, four longitudinal flanges 2D of arched cross section respectively raised from the outside wall thereof in the four corners and side-matched with the four longitudinal grooves 1A of the key base 1'. The longitudinal flanges 2D of the key body 2' have each a bottom end terminating in a respective hooked portion 2B, which stops below an inward top flange on the key base 1' to keep the key body 2' coupled to the key base 1' when the key cap 3' is not depressed. A key switch has drawbacks. Because the longitudinal flanges 2D are side-matched with the longitudinal grooves 1A through surface contact but not point contact, a great friction force will be produced when the key body 2' is moved relative to the key base 1', and therefore the movement of the key body 2' will be affected. Because the top of the rubber cone 4' is closely attached to the flat bottom 2C of the key body 2', a vacuum will be produced upon each stroke of the key cap 3', causing the upward stroke of the key body 2' to be hindered. Furthermore, the design of the triangular slots 2A and longitudinal flanges 2D with hooked portions 2B complicates the injection molding process of the key body 2', causing the manufacturing cost of the key switch to be relatively increased.

SUMMARY OF THE INVENTION

The present invention has been accomplished to provide a key switch which eliminates the aforesaid drawbacks. It is therefore an object of the present invention to provide a key switch which produces little friction force during its operation so that the movement of the key body thereof is smoothed. It is another object of the present invention to provide a key switch which eliminates the formation of a vacuum during its operation. It is still another object of the present invention to provide a key switch which is inexpensive to manufacture and easy to assemble.

To achieve the aforesaid objects, there is provided a key switch comprised of a square key base having an inward facing top flange around the four sides thereof, four 45° angle bevel edges on the inward facing in the four corners thereof, and four notches on the inward facing flange in the middle of either side thereof; a key base having four air passage holes longitudinally disposed in the four corners of the square center through-hole thereof, four cylindrical flanges longitudinally raised from the four corners thereof and side-matched with either 45° angle bevel edge on the inward top flange of the key base, four stub rods respectively extended down from the cylindrical flanges and stopped below the inward top flange, and a projection raised from one side thereof in the middle at the top and vertically disposed in line with one notch on the inward top flange of the key base for guiding vertical movement of the key body within the key base; and a key cap having a plunger fitted into the square center through-hole on the key body and moved to compress a rubber cone below in triggering a circuit, and a inside hole on the plunger communicating with the air passage holes for exhaust of compressed air. Because the cylindrical flanges of the key body are respectively disposed in contact with the key base at three contact points, less friction force is produced when the key body is moved relative to the key base. When the key cap is depressed, compressed air is guided out of the key switch through the inside hole on the plunger and the air passage holes on the key body, and therefore no vacuum is produced.

DETAILED DESCRIPTION OF THE PREFERRED EMBODIMENT

Figure 1:
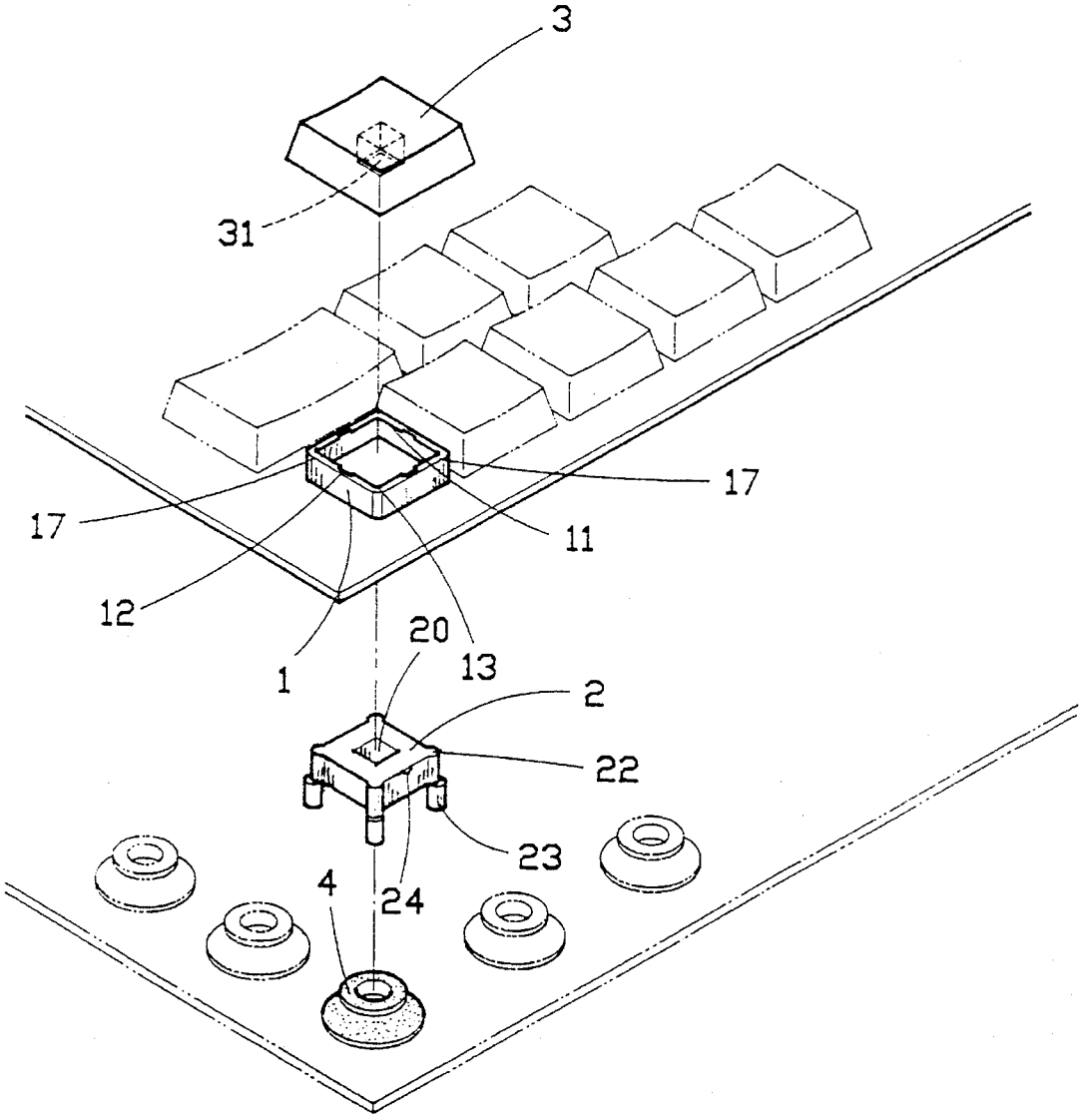
FIG. 1 is an exploded view of a key switch according to the present invention.

Referring to FIG. 1, a key switch in accordance with the present invention is generally comprised of a key base 1, a key body 2, a key cap 3, and a rubber cone 4. The key cap 3 and the key body 2 are respectively molded integrally from plastics. The key base 1 is a square open frame having an inward extending flange 11 horizontally disposed at the top around the four sides thereof, four 45° angle bevel edges 13 on the inward flange 11 in the four corners 17 thereof, four notches 12 on the inward flange 11 in the middle of either side thereof. The key body 2 comprises a square center through hole 20, four air passage holes 21 longitudinally disposed through (i.e., along) the four corners of the square center through hole 20, four cylindrical flanges 22 raised from the four corners thereof in the longitudinal direction, four stub rods 23 respectively extended downwards from the cylindrical flanges 22, and a projection 24 raised from one side thereof in the middle at the top. The key cap 3 comprises a unitary plunger 31 at the bottom fitted into the square center through hole 20 of the key body 2. The plunger 31 is made in a hollow structure having an inner hole 310. The rubber cone 4 is disposed beneath the key body 2 and compressed to trigger the circuit below (not shown).

Figure 2:
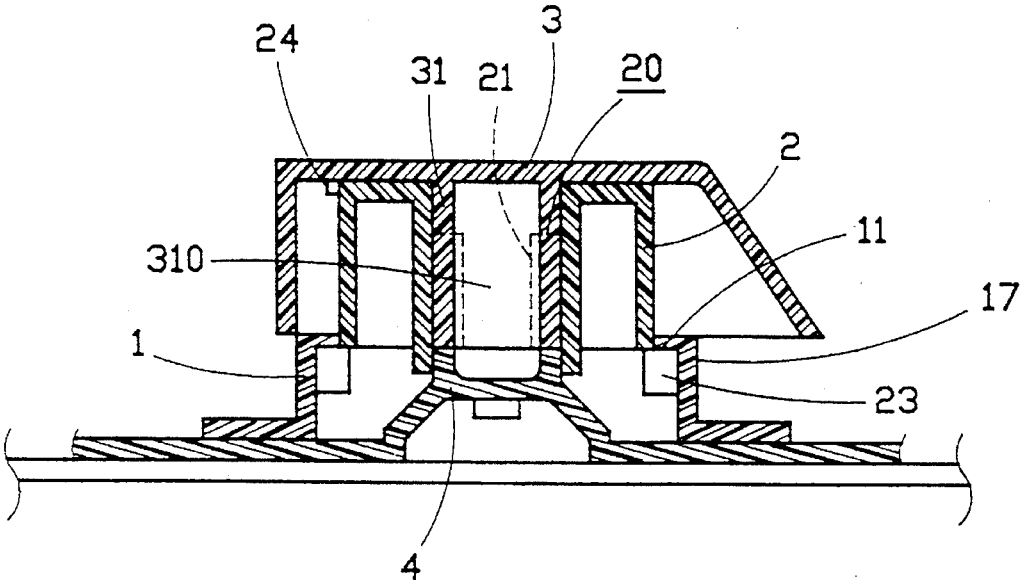
FIG. 2 is a sectional elevation of the key switch shown FIG. 1.
Figure 3:
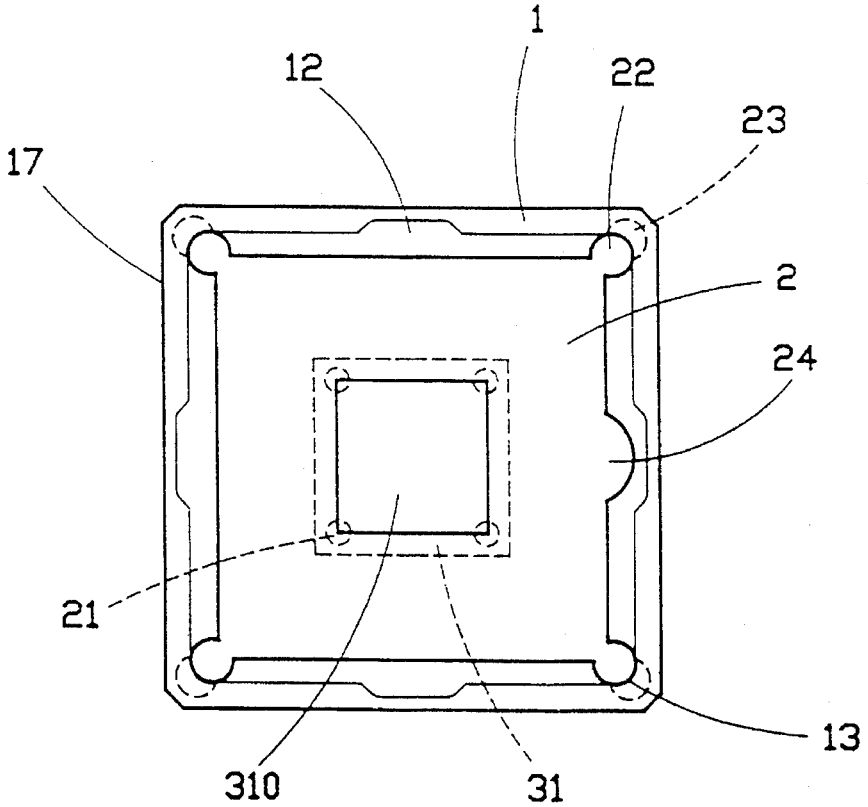
FIG. 3 is a top plain view of the key switch shown in FIG. 2.
Figure 4:
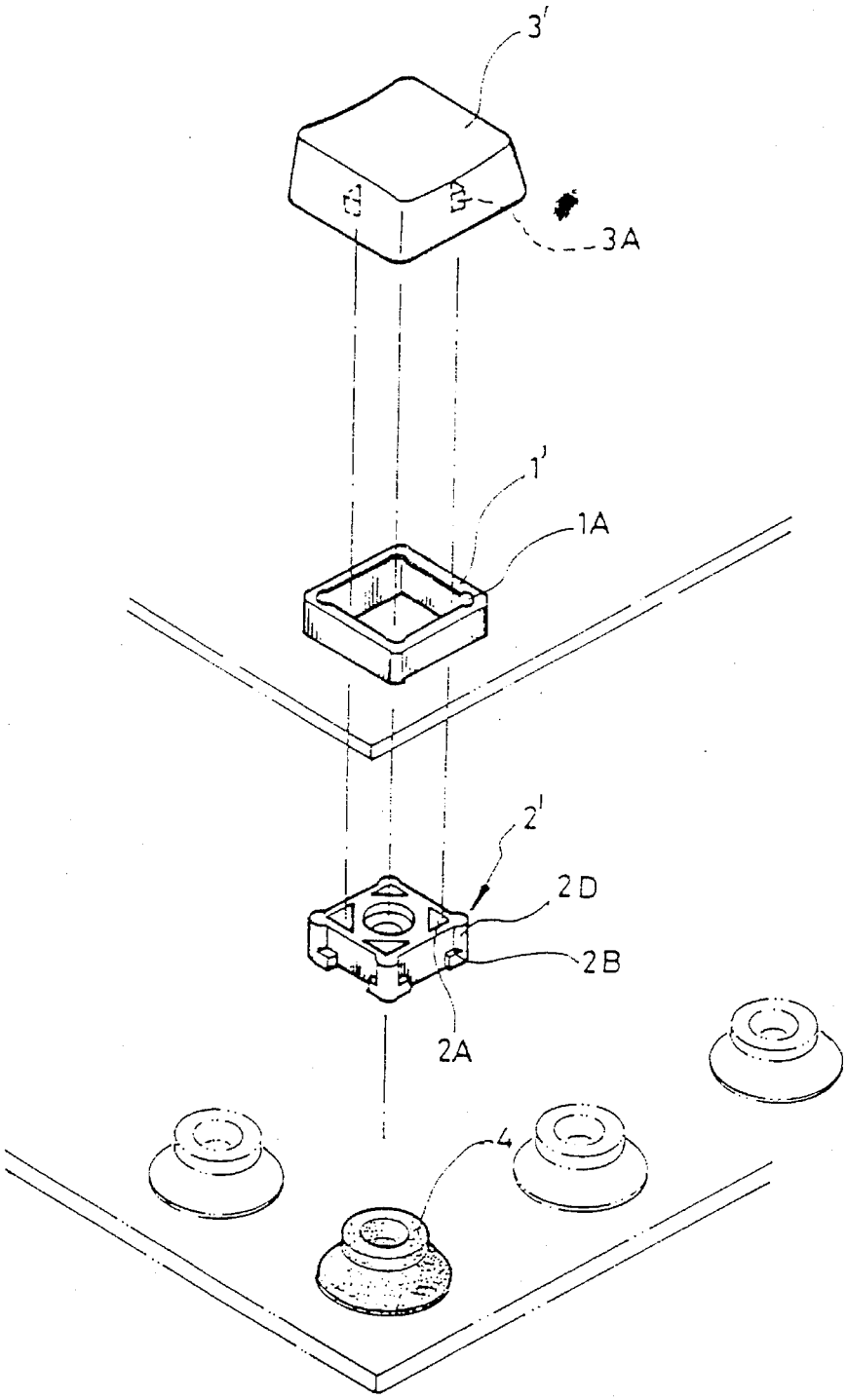
FIG.4 PRIOR ART
FIG. 4 is an elevational view of a key switch according to the prior art.
Figure 5:
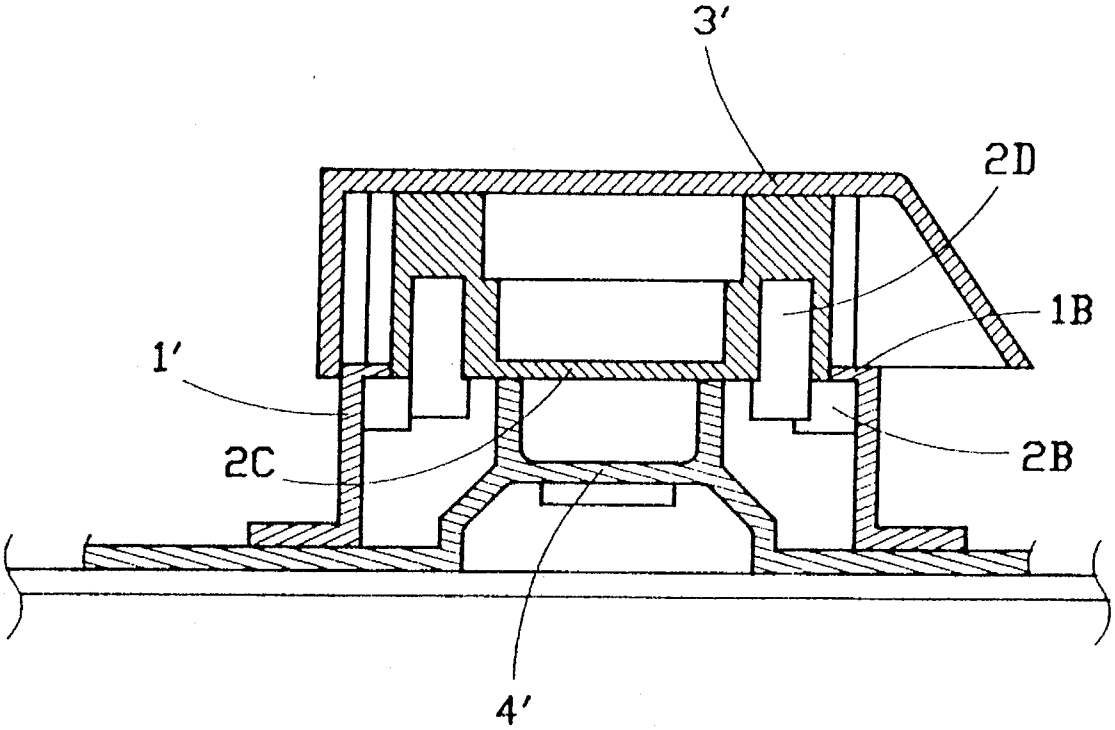
FIG.5 PRIOR ART
FIG. 5 is a sectional elevation of the key switch shown in FIG. 4.

Referring to FIGS. 2 and 3 and FIG. 1 again, the key base 1 is integrally made on the frame of a computer keyboard; the key body 2 is inserted into the key base 1 from the bottom with the cylindrical flanges 22 respectively side-matched with the bevel edges 13 and the stub rods 23 stopped below the inward flange 11 and the projection 24 disposed in line with one notch 12 on the key base 1; the plunger 31 is squeezed into the square center through hole 20 of the key body 2 from the top causing the key body 2 and the key cap 3 to be joined together. When assembled, the cylindrical flanges 22 of the key body 2 are disposed in contact with the key base 1 through a respective three-point contact, i.e. each cylindrical flange 22 has three contact points respectively disposed in contact with either bevel edge 13 and the inward flange 11. Because the key base 1 has four notches 12 respectively disposed on the inward flange 11 thereof at the four sides, the key body 2 and the key base 1 can be quickly assembled without considering the direction of the projection 24. When the key cap 3 is depressed, compressed air can be smoothly guided out through the inner hole 310 on the plunger 31 of the key cap 3 and the air passage holes 21 on the key body 2 eliminate vacuum between the key body 2 and the rubber cone 4, and therefore the reciprocating movement of the key body 2 is smoothed.

Because the key cap 3 and the key body 2 are respectively molded integrally from plastics and the key base 1 is directly made integrally on the frame of the keyboard, the manufacturing cost of the key switch is greatly reduced.

What is claimed is:

1. For a keyboard having a keyboard frame and a circuit board disposed below the keyboard frame, a key switch comprising:

a key cap including a plunger, the plunger including a downward-opening inner hole;

a key base including four walls upstanding from the keyboard frame in a square configuration, the four walls defining four base corners therebetween, four flanges extending inwardly from respective ones of the walls at an upper end of the key base, a flange notch in the middle of each of the flanges, and four 45-degree bevels extending, between adjacent flanges, across each of the base corners at the upper end of the key base;

a key body including four stub rods slidably disposed within the base corners of the key base, each of the stub rods including a respective cylindrical stop for abutting against an underside of a respective one of the bevels to restrain upward sliding of the key body within the key base, a central square through-hole having four body corners and sized to accept therein the plunger of the key cap, four air passages disposed along the body corners of the through-hole, the air passages each communicating between the inner hole of the key cap and a space outside of the key, and a single projection aligned with one of the flange notches; and a rubber cone disposed between the circuit board and a lower end of the plunger for exerting upward force on the key cap, the rubber cone being compressed when the key body is depressed to trigger a circuit of the circuit board.

* * * * *